US011514882B2

(12) United States Patent
Zollner

(10) Patent No.: US 11,514,882 B2
(45) Date of Patent: Nov. 29, 2022

(54) FEEDFORWARD ACTIVE NOISE CONTROL

(71) Applicant: Harman Becker Automotive Systems GmbH, Karlsbad (DE)

(72) Inventor: Juergen Zollner, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 17/052,045

(22) PCT Filed: Jul. 31, 2018

(86) PCT No.: PCT/EP2018/070747
§ 371 (c)(1),
(2) Date: Oct. 30, 2020

(87) PCT Pub. No.: WO2019/210983
PCT Pub. Date: Jul. 11, 2019

(65) Prior Publication Data

US 2021/0193103 A1 Jun. 24, 2021

(30) Foreign Application Priority Data

May 2, 2018 (EP) ..... 18170365

(51) Int. Cl.
*G10K 11/178* (2006.01)

(52) U.S. Cl.
CPC .. *G10K 11/17835* (2018.01); *G10K 11/17823* (2018.01); *G10K 11/17854* (2018.01); *G10K 11/17881* (2018.01)

(58) Field of Classification Search
CPC ..... G10K 11/17835
See application file for complete search history.

(56) References Cited

U.S. PATENT DOCUMENTS 6,990,207 B2 1/2006 Nakamura et al.
9,294,837 B2 3/2016 Sakamoto et al.
(Continued)

FOREIGN PATENT DOCUMENTS

EP 2133866 A1 12/2009
EP 3107312 A1 12/2016
GB 2441835 A 3/2008

OTHER PUBLICATIONS

International Search Report dated Feb. 7, 2019, PCT/EP2018/070747 filed Jul. 31, 2018, 13 pgs.

*Primary Examiner* — Ping Lee
(74) *Attorney, Agent, or Firm* — Brooks Kushman P.C.

(57) ABSTRACT

Sound reduction includes producing an error signal representative of sound present in a target space, producing a reference signal corresponding to undesired sound present in the target space, and producing, based on the reference signal and the error signal a cancelling output signal representative of the undesired sound present in the target space. The method further includes producing, based on the cancelling output signal, sound to destructively interfere with the undesired sound present in the target space, and limiting the amplitude or power of at least one of the reference signal, the error signal and the cancelling output signal if a first condition is met, the at least one signal under examination is at least one of the reference signal, the error signal and the cancelling output signal, and fully or partially suspending the active noise controller update mechanism if a second condition is met.

25 Claims, 9 Drawing Sheets

(56) References Cited

U.S. PATENT DOCUMENTS

| | | | | |
|---|---|---|---|---|
| 2012/0140943 | A1 | 6/2012 | Hendrix et al. | |
| 2014/0072134 | A1 | 3/2014 | Po et al. | |
| 2014/0126733 | A1 | 5/2014 | Gauger, Jr. et al. | |
| 2018/0301134 | A1* | 10/2018 | Le | H04R 1/1083 |
| 2021/0014593 | A1* | 1/2021 | Araki | H04R 3/02 |

* cited by examiner

| | Limiter Activity | | | | |
|---|---|---|---|---|---|
| Error Limiter | No | Yes | No | Yes | Yes/No |
| Referenz Limiter | No | No | Yes | Yes | Yes/No |
| Output Limiter | No | No | No | No | Yes |
| Mode as per Equation | (3) | (4) | (4) | (4) | (5) |

| Configuration → Selection method ↓ | Config-A | Config-B | Config-C |
|---|---|---|---|
| Signal above THRL, select configuration via tuning. | Limiting: Limit signal, apply calculated $\alpha_{\lim_current}$<br><br>Updating: No impact, apply equation (3) on update mechanism | Limiting: No limiting on the limiter output signal, only calculate the potential amplification signal $\alpha_{\lim_current}$ is<br><br>Updating: Dependent on comparison result $\alpha_{\lim_current} < \alpha_{\lim_default}$, and which limiter is active, apply update mechanism according to equation (4) or (5) | Limiting: Limit signal, apply calculated $\alpha_{\lim_current}$<br><br>Updating: Dependent on comparison result $\alpha_{\lim_current} < \alpha_{\lim_default}$, and which limiter is active, apply update mechanism according to equation (4) or (5) |

FIG 17

| KxM W-Filter Matrix | Ouput-1 /Lim nicht aktiv | Ouput-1 /Lim nicht aktiv | Ouput-1 /Lim aktiv |
|---|---|---|---|
| Reference-1 /Lim nicht aktiv | EQ-3 / Matrix-Element x 1,1 | EQ-3 / Matrix-Element x 1,2 | EQ-5 / Matrix-Element x 1,3 |
| Reference-2 /Lim nicht aktiv | EQ-3 / Matrix-Element x 2,1 | EQ-3 / Matrix-Element x 2,2 | EQ-5 / Matrix-Element x 2,3 |
| Reference-3 /Lim aktiv | EQ-4 / Matrix-Element x 3,1 | EQ-4 / Matrix-Element x 3,2 | EQ-5 / Matrix-Element x 3,3 |
| Reference-4 /Lim nicht aktiv | EQ-3 / Matrix-Element x 4,1 | EQ-3 / Matrix-Element x 4,2 | EQ-5 / Matrix-Element x 4,3 |

FIG 19

FEEDFORWARD ACTIVE NOISE CONTROL

CROSS-REFERENCE TO RELATED APPLICATION

This application is the U.S. national phase of PCT Application No. PCT/EP2018/070747 filed on Jul. 31, 2018, which claims priority to European Application No. 18170365.3 filed May 2, 2018, the disclosures of which are incorporated in their entirety by reference herein.

BACKGROUND

1. Technical Field

The disclosure relates to active noise control systems and methods (generally referred to as systems), and more specifically to feedforward active noise control systems and methods.

2. Related Art

Active noise control (ANC) is used to generate sound waves that destructively interfere with undesired sound waves. The destructively interfering sound waves may be produced by a loudspeaker to combine with the undesired sound waves. Different types of ANC structures such as feedback structures, feedforward structures and combinations thereof exist. Feedforward ANC structures require particular attention regarding stability and robustness against disturbances. For example, standard least-mean-square (LMS) algorithms implemented in ANC structures and supported by hardware commonly do not have any sufficient stability mechanism. Therefore, a need exists to increase the stability of feedforward ANC structures.

SUMMARY

An automatic noise control system includes an error sensor configured to produce an error signal representative of sound present in a target space, and a reference source configured to produce a reference signal corresponding to undesired sound present in the target space. The system further includes an active noise controller operatively coupled with the error sensor and the reference sensor, the active noise controller being configured to produce, based on the reference signal and the error signal, a cancelling output signal representative of the undesired sound present in the target space, and a transducer operatively coupled with the active noise controller and configured to produce, based on the cancelling output signal, sound to destructively interfere with the undesired sound present in the target space. The active noise controller is further configured to limit the amplitude or power of at least one signal under examination if a first condition is met, the at least one signal under examination being at least one of the reference signal, the error signal and the cancelling output signal, and to fully or partially suspend the active noise controller update mechanism if a second condition is met.

A sound reduction method includes producing an error signal representative of sound present in a target space, producing a reference signal corresponding to undesired sound present in the target space, and producing, based on the reference signal and the error signal, a cancelling output signal representative of the undesired sound present in the target space. The method further includes producing, based on the cancelling output signal, sound to destructively interfere with the undesired sound present in the target space, and at least one of limiting the amplitude or power of at least one signal under examination if a first condition is met, the at least one signal under examination being at least one of the reference signal, the error signal and the cancelling output signal, and fully or partially suspending the active noise controller update mechanism if a second condition is met.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures (FIGS.) are not necessarily to scale, with an emphasis instead being placed upon illustrating the principles of the invention. Moreover, in the figures, like referenced numerals designate corresponding parts throughout the different views.

FIG. 17 is a table illustrating an exemplary modification of the implementation shown in FIG. 11.

FIG. 19 is a table illustrating various implementations of a partial update.

DETAILED DESCRIPTION

Figure 1:
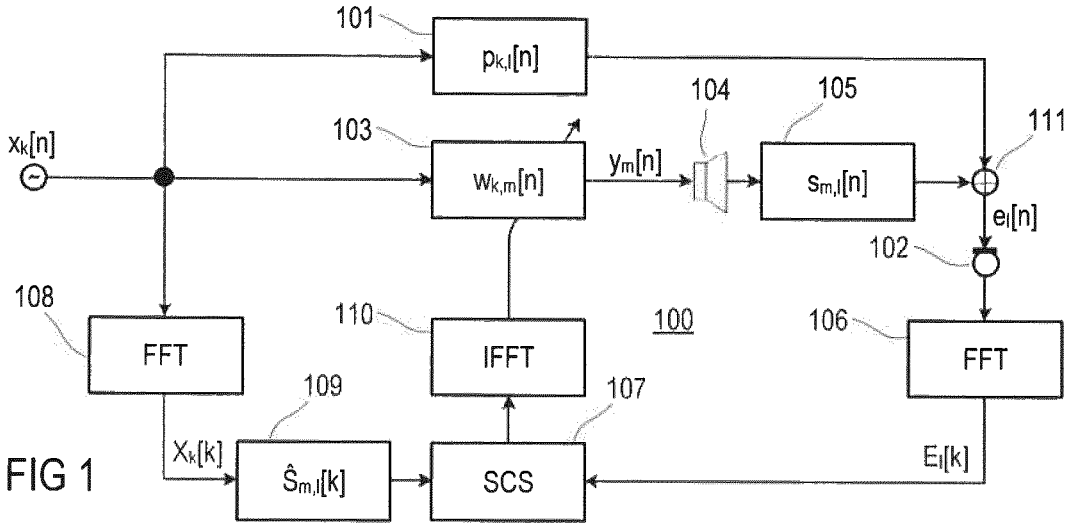
FIG. 1 is a schematic diagram illustrating an exemplary basic multi-channel automatic noise control system of the feedforward type.

Referring to FIG. 1, an example feedforward ANC system 100 and an example physical environment are represented in a block diagram format. In one example, undesired sound represented by K≥1 time domain reference signals $x_k[n]$, wherein k=1, . . . , K and K is an integer, may traverse physical paths, referred to as K·L acoustic primary paths 101, from each of K sources (not shown) of the reference signals $x_k[n]$ to each of L≥1 error sensors, e.g., microphones 102, that produce L time domain error signals $e_l[n]$, wherein l=1, . . . , L and L is an integer. The K·L primary paths 101 have time-domain transfer functions $p_{k,l}[n]$, with which the reference signals $x_k[n]$ are filtered. The reference signals $x_k[n]$ represent the undesired sound both physically and digitally, wherein a digital representation may be produced with the use of an analog-to-digital (A/D) converter. The reference signals $x_k[n]$ are also used as inputs to a matrix of K·M adaptive filters 103. The adaptive filters 103 have time domain transfer functions $w_{k,m}[n]$ and may be time domain digital filters such as finite impulse response (FIR) filters or any other appropriate type of filters, each configured to be dynamically adapted to filter a corresponding one of reference signals $x_k[n]$ in order to produce M≥1 anti-noise signals $y_m[n]$ as an output, wherein m=1, . . . , M and M is an integer.

The anti-noise signals $y_m[n]$ drive M transducers, e.g., loudspeakers 104, which output corresponding sound waves that travel M·L physical paths, referred to as acoustic secondary paths 105, which extend from each of the loudspeakers 104 to each of the microphones 102. The secondary paths 105 in the example system shown in FIG. 1 have time domain transfer functions $s_{m,l}[n]$. The sound waves produced by loudspeakers 104 based on the anti-noise signals $y_m[n]$ are filtered with the transfer functions $s_{m,l}[n]$, and then combined (added) with the signals from the primary paths 101 to form inputs into the microphones 102, which are represented by L summing nodes 111 (one node 111 per microphone 102) that perform summation operations in the example system shown in FIG. 1 to produce the input signals for the microphones 102 that are to be transformed into the error signals $e_l(n)$.

The error signals $e_l[n]$ output by the microphones 102 are transformed from the time domain into the frequency domain (also known as spectral domain) by way of time-to-frequency domain transformers 106 which provide frequency domain error signals $E_l[k]$. The frequency domain error signals $E_l[k]$ are transmitted to M·L filter controllers 107 which also receive as inputs the reference signals $x_k[n]$ after they have been transformed into frequency domain reference signals $X_k[k]$ and filtered in the spectral domain by a matrix of M·L filters 109. The filters 109 have frequency domain transfer functions $\hat{S}_{m,l}[k]$ and are configured to simulate, estimate or model frequency domain transfer functions $S_{m,l}[k]$ which correspond to the time domain transfer functions $s_{m,l}[n]$ of the secondary paths 105. The filter controllers 107 update the adaptive filters 103 by way of update signals in the frequency domain which are transformed into time domain update signals by way of frequency-to-time domain transformers 110 before they are supplied to the matrix of adaptive filters 103. The adaptive filters 103 receive the undesired time domain reference signals $x_k[n]$ and the time domain update signals and adjust more accurately the anti-noise signals $y_m[n]$.

Time-to-frequency domain transformers 106 and 108 may employ fast Fourier transformation (FFT) as shown or any other appropriate time-to-frequency domain transform algorithm including Discrete Fourier Transformation (DFT) and filter banks. Frequency-to-time domain transformers 110 may employ inverse fast Fourier transformation (IFFT) as shown or any other appropriate frequency-to-time domain transform algorithm. In respect thereof, [n] denotes the $n^{th}$ sample in the time domain and [k] the $k^{th}$ bin in the frequency domain. Further, time domain reference signals $x_k[n]$ are provided within k=1 sample in K reference channels.

The filter controllers 107 may implement one of various possible adaptive control structures, such as least mean squares (LMS), recursive least mean squares (RLMS), normalized least mean squares (NLMS), or any other suitable algorithm. In the example system shown in FIG. 1, the filter controllers 107 employ summed cross spectra which can be used to update the transfer functions of the adaptive filters 103 and which is here used to implement an LMS scheme in the frequency domain. Measured secondary paths are only a snapshot of a given set-up, so they may be treated as estimations and represent a significant contribution to the adaptation process realized in the summed cross spectrum. The summed cross spectrum for each combination of m and k can be described as set forth in equation (1):

$$SCS_{k,m}[k] = \sum_{l=1}^{L} conj(X_k[k]\hat{S}_{m,l}[k])E_l[k] \tag{1}$$

Taking this into consideration, updating the matrix of K·M time domain transfer functions $w_{k,m}[n]$, e.g., represented by FIR filter taps, can be described as set forth in equations (2) and (3):

$$W_{old,k,m}[k] = FFT\{w_{k,m}[n]\} \tag{2}$$

$$w_{k,m}[n+1] = IFFT\left\{\lambda_{k,m}[k]\cdot W_{old,k,m}[k] - \mu_{k,m}[k]\cdot\frac{SCS_{k,m}[k]}{\sqrt{X_k[j]conj(X_k[k])}}\right\} \tag{3}$$

wherein $w_{k,m}[n+1]$ represents an update of the K·M time domain transfer functions $w_{k,m}[n]$, $W_{old,k,m}[k]$ is the matrix of K·M frequency domain transfer functions corresponding to the not-updated time domain transfer functions $w_{k,m}[n]$, $\lambda_{k,m}[k]$ is a matrix of K·M individually tuned, frequency dependent leakage values, $\mu_{k,m}[k]$ is a matrix of K·M individually tuned, frequency dependent adaptation step sizes, and $SCS_{k,m}[k]$ is a matrix of convergence values in the frequency domain representing the summed cross spectrum.

The update mechanism may utilize a normalized filtered-x least mean square (NFXLMS) filter update routine including normalization by the energy of the reference signal and applying individually tuned frequency dependent step-size and leakage. In the example described in the following, it is not distinguished between different types of NFXLMS but the previously described normalization is employed. The normalization applies a reciprocal scaling to the summed cross spectrum by the energy of the reference signal. Hence, the convergence step size automatically adjusts to the energy of the reference signal, allowing an adaptation rate that is as fast as possible and is independent of the energy content of the reference signals. Although the normalization may already improve ANC systems, one or more further techniques may be applied in order to enhance at least one of stability and performance.

One such further technique is the integration of one or more limiting elements or processes, referred to generally as limiters (including compressors), into the ANC structure. Limiting is, for example, any process by which the amplitude or power of a signal is prevented from exceeding a predetermined value. Limiting may be applied if a first condition, such as exceeding a predetermined or dynamic limiter threshold, is met by the signal under examination. The herein described usage of limiters is not limited to certain types of limiters, including simple, delay-less peak limiters. Nevertheless, the type of limiter used may be restricted in one example by putting emphasis on the threshold characteristic of the limiter. In this example, thresholds may be individually tunable so that the limiter provides protection against overshoots and clipping artefacts in a way that avoids disturbances which would pass through the system and create artefacts, and that constrain the degeneration of the FXLMS update behavior as a consequence thereof.

A further technique for protecting the behavior of the FXLMS update mechanism, which can be applied alternatively or additionally to limiting at least one of the reference signal, error signal or cancelling output signal, is fully or partially suspending (including freezing, presetting etc.) the update mechanism if the signal under examination meets the first condition for limiting this signal and, additionally, a second condition is met, e.g., by the limiter or the signal. In one example, the first and the second conditions may be the same. The detection of the second condition can be implemented in multiple ways. In one example, the limiter is additionally employed as a detector and the second condition may be detected if a current amplification $\alpha_{lim_current}$ of this limiter is less than a default limiter amplification $\alpha_{lim_default}$ that occurs when the limiter is supplied with (detects) a signal under examination that is below the given limiter threshold. The update suspension dependency on the limiter activity is set forth in equation (4):

If the first condition is not met, neither the respective signal is limited nor the update mechanism suspended.

A limiter can be included in the signal flow at various positions. In the examples presented below, only some exemplary positions suitable for time-domain processing are described. However, a limiter can also be implemented in the frequency domain. The combination of several limiters can be useful, for example, if the update process fails to utilize any dedicated stability creating techniques, which may be implemented in standard least mean square (LMS) processing blocks with native hardware support. For example, spikes within the reference signals and/or error signals may create misleading update terms and could cause instability. In this case, limiters can be very efficient in suppressing instability while having minimal impact on computational power and memory consumption.

Figure 2:
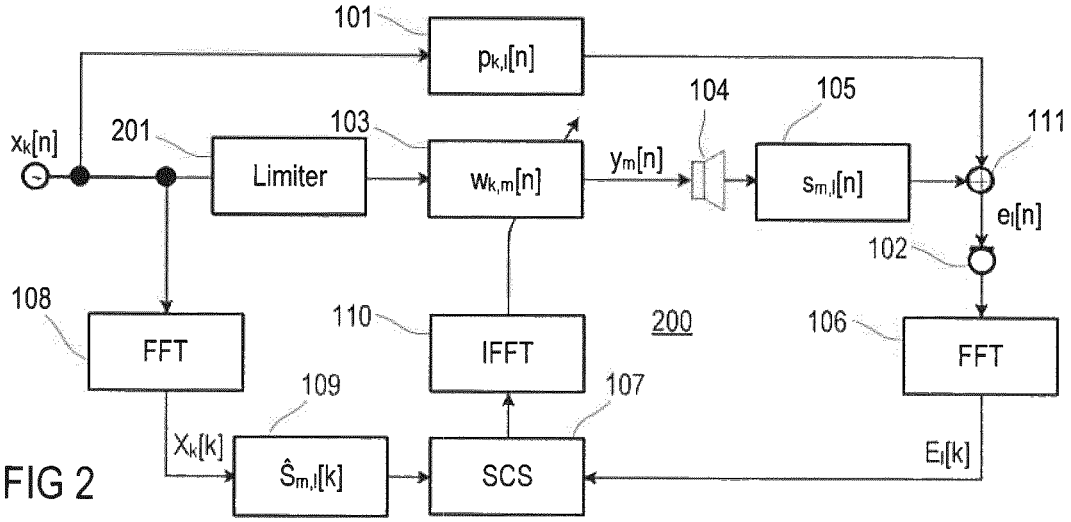
FIG. 2 is a schematic diagram illustrating the automatic noise control system shown in FIG. 1 with time domain limiters in reference input paths.
Figure 3:
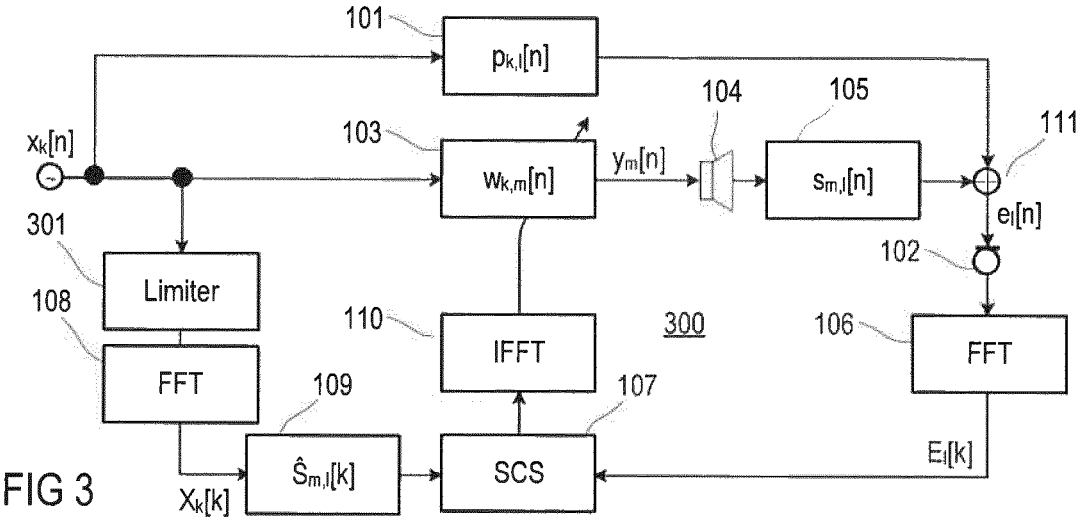
FIG. 3 is a schematic diagram illustrating the automatic noise control system shown in FIG. 1 with time domain limiters in reference control paths.

Two example positions within an ANC structure that are configured to limit the reference signal(s) are illustrated in FIGS. 2 and 3. In one example ANC system 200 shown in FIG. 2, which is based on the ANC system 100 described above in connection with FIG. 1, a limiting element 201 is inserted in the input path(s) of filter(s) 103. This protects against disturbances originating from the reference signal(s) or channel(s). In another example ANC system 300 shown in FIG. 3, which is also based on the ANC system 100 described above in connection with FIG. 1, a limiting element 301 is inserted in the update-path of controller 107 and protects the update-mechanism against disturbances originating from the reference signal(s) or channel(s).

Figure 4:
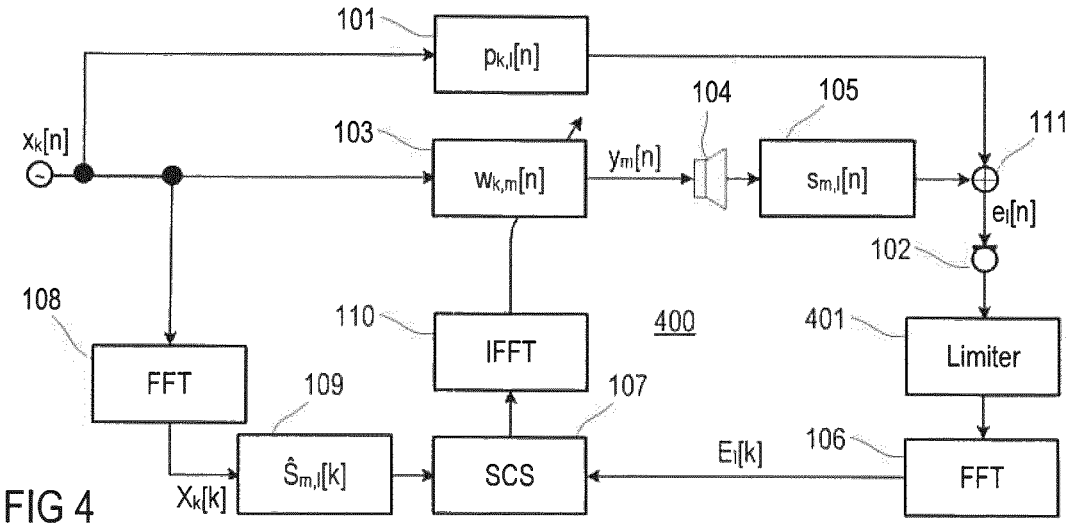
FIG. 4 is a schematic diagram illustrating the automatic noise control system shown in FIG. 1 with time domain limiters in error control paths.

Similar to protecting the update mechanism against reference signal disturbances, it can also be protected against disturbances emanating from the error signals. For example, the error signals may be affected by impulsive noise such as wind noise close to an error microphone or an object taping against an error microphone. In the ANC system 400 depicted in FIG. 4, which is based on the ANC system 100 described above in connection with FIG. 1, a limiter 401 is inserted in the output paths of microphones 102 to stabilize the update-mechanism.

Figure 5:
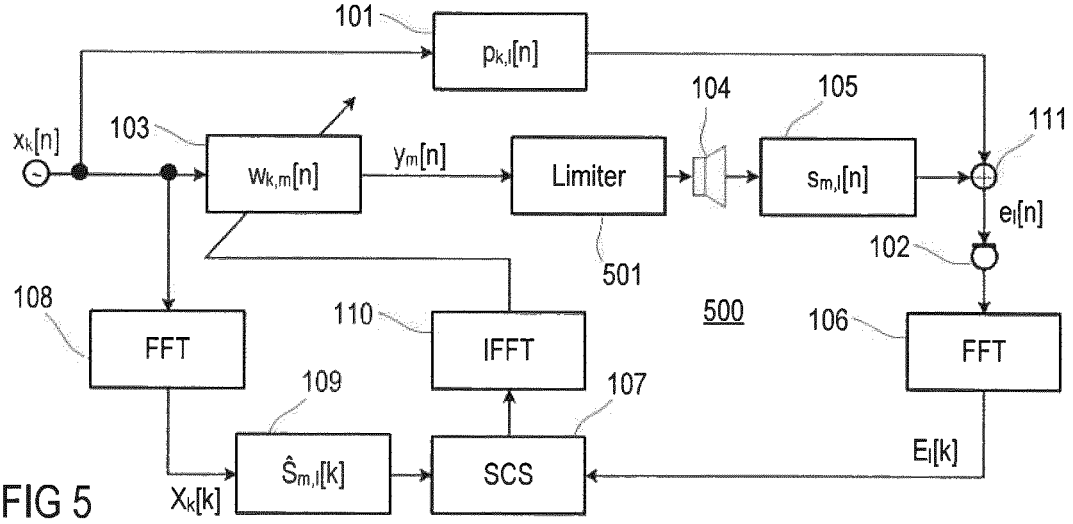
FIG. 5 is a schematic diagram illustrating the automatic noise control system shown in FIG. 1 with time domain limiters in output paths.

In addition to protecting the forward path on its entry point against reference signal disturbances, e.g., by inserting limiters 201 in the input paths of filters 103 as shown in FIG. 2, the forward path can also be protected, e.g., by inserting limiters 501 in the output paths of filters 103 as shown in FIG. 5 which is based on the ANC system 100 described above in connection with FIG. 1. The actors, i.e., here the speakers 104, are protected on one hand and, on the other hand, the effect of any output signal disturbance is limited.

$$w_{k,m}[n+1] = \begin{cases} IFFT\left\{\lambda_{k,m}[k] \cdot W_{old,k,m}[k] - \mu_{k,m}[k] \cdot \dfrac{SCS_{k,m}[k]}{\sqrt{X_k[k]conj(X_k[k])}}\right\}, & \alpha_{lim_current} \geq \alpha_{lim_default} \\ IFFT\{W_{old,k,m}[k]\}, & \alpha_{lim_current} < \alpha_{lim_default} \end{cases} \quad (4)$$

For example, one of the following modes of operation may apply if the first condition is met: (a) The signal under examination is limited but the update mechanism is not suspended, e.g., dependent on whether the second condition is met or not, (b) the update mechanism is fully or partially suspended but the signal under examination is not limited e.g., dependent on whether the second condition is met or not, and (c) the signal under examination is limited and the update mechanism is fully or partially suspended e.g., dependent on whether the second condition is met or not. (d) For example, if the filters 103 have diverged and themselves generate disturbances, first the limiters 501 may avoid damage to the system and the user(s). Second, they may allow the update mechanism to return to normal operation with the aid of the feedback of the error signals.

The update mechanism may not only be fully or partially suspended, but also the return to normal operation may be enhanced by applying dedicated leakage values during the update as set forth in equation (5):

$$w_{k,m}[n+1] = \begin{cases} IFFT\left\{\lambda_{k,m}[k] \cdot W_{old,k,m}[k] - \mu_{k,m}[k] \cdot \frac{SCS_{k,m}[k]}{\sqrt{X_k[k]conj(X_k[k])}}\right\}, & \alpha_{out_lim_current} \geq \alpha_{out_lim_default} \\ IFFT\{\lambda_{output-lim_{k,m}}[k] \cdot W_{old,k,m}[k], & \alpha_{out_lim_current} < \alpha_{out_lim_default} \end{cases} \quad (5)$$

where $\lambda_{output\text{-}lim_{k,m}}[k]$ is a matrix of KM individually tuned, frequency dependent (output) limiter leakage values, which are tuned to quickly stabilize the update mechanism. If at least one limiter is active in at least one of the reference path or error path (time or spectral domain), only the update of the W transfer function is fully or partially suspended or frozen as can be seen from equation 4 above. If a limiter is active in an output path, not only is the update fully or partially suspended or frozen, but also a "specific" leakage $\lambda_{output\text{-}lim_{k,m}}[k]$ is applied instead of the otherwise applied "normal" leakage $\lambda_{k,m}[k]$ as can be seen from equation 5, which means that a "more aggressive" leakage be applied in such a case. A "more aggressive" leakage has the effect that the W transfer function is controlled to reduce higher output signal levels which would otherwise be controlled by the output limiter(s). Since the freeze mechanism and/or the "specific" leakage $\lambda_{output\text{-}lim_{k,m}}[k]$ can be selective upon the k×m matrix, the selectivity can be based on specific channels based on channel showing limiter activity. Additionally, the current output limiter amplification is $\alpha_{out_lim_current}$, the default output limiter amplification is $\alpha_{out_lim_default}$, the previously defined current limiter amplification $\alpha_{lim_current}$ and the default limiter amplification $\alpha_{lim_default}$ are differentiated by introducing the amplification values for reference and error signal limiters, in which $\alpha_{ref_lim_current}$ and $\alpha_{ref_lim_default}$ are the current limiter amplification and default reference limiter amplification and $\alpha_{err_lim_current}$ and $\alpha_{err_lim_default}$ are the current limiter amplification and default error limiter amplification.

All limiters used herein have a (specific) default amplification $\alpha_{lim_default}$ which represents the amplification in the inactive state of the limiter, i.e., when no limiting of the limiter input signal occurs. Otherwise a "current amplification" which depends on the limiting situation is applied. Thus, if the limiter is inactive, the (e.g., constant) default amplification is used. If the limiter is active, the (e.g., variable) current amplification applies. As a positive side effect, the attack and release behaviors of the limiter are intrinsically also affected. Depending on the situation in which a limiter is operated, the limiter may have a specific a current amplification $\alpha_{lim_current}$ and a default amplification $\alpha_{lim_default}$. For example, a reference limiter, i.e., a limiter included in the reference signal path, may have a current amplification $\alpha_{ref_lim_current}$ and a default amplification $\alpha_{ref_lim_default}$. An error limiter, i.e., a limiter included in the error signal path, may have a current amplification $\alpha_{err_lim_current}$ and a default amplification $\alpha_{err_lim_default}$. An output limiter, i.e., a limiter included in the output signal path, may have a current amplification $\alpha_{out_lim_current}$ and a default amplification $\alpha_{out_lim_default}$.

The limiters may not only be inserted at a single position as described above in connection with FIGS. 2 to 5, but also at multiple positions in the ANC structure. Further, the limiters may not only operate in the time domain but also in the frequency domain. In an example ANC system 600 shown in FIG. 6, which is based on the ANC system 100 described above in connection with FIG. 3, additional limiters 601, which operate in the frequency domain, are inserted between the time-to-frequency domain transformers 106 and filter controllers 107. Employing one or more limiters within the forward and/or update paths in the time domain or frequency domain improves the overall ANC system stability and robustness against disturbances. If several limiters are employed in the reference or error signal paths, the update suspension mechanisms may be linked between these limiters. Since the output limiter's impact to the update mechanism is different, the suspension mechanism of the output limiter may not be linked to the suspension mechanisms of the other limiters, e.g., may work independently from the other limiters and super-rule the other update mechanisms (strategies). For example, if an LMS based algorithm is supported by dedicated hardware, it is almost impossible to change the algorithm. Here, the limiters provide design options that improve the stability while having minimal impact on computational power and memory consumption.

Figure 7:
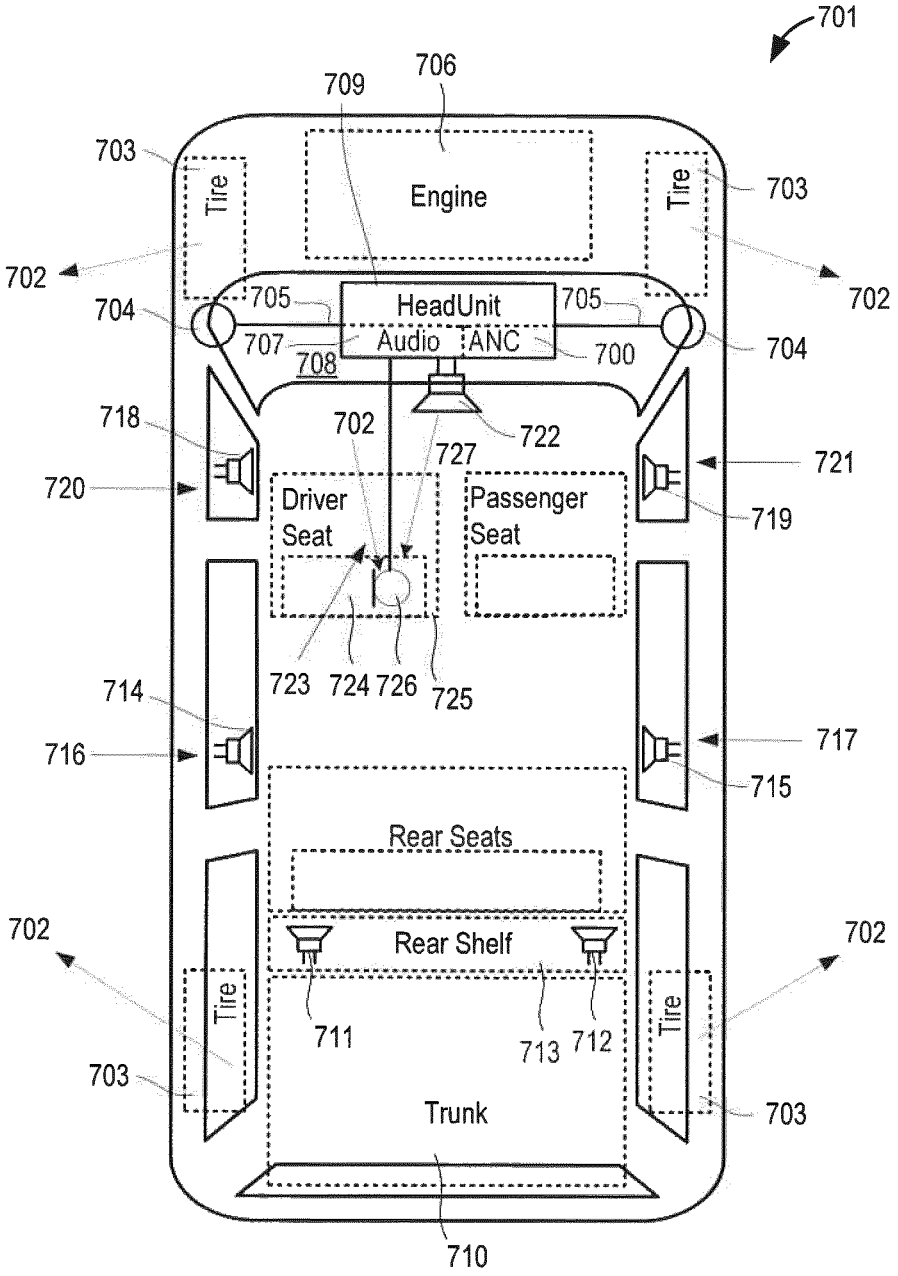
FIG. 7 is a top view of an example vehicle implementing an example automatic noise control system such as the systems shown in FIGS. 2 to 6.

Referring to FIG. 7, an example ANC system 700, which may be identical or similar to any of ANC systems 200, 300, 400 and 50 shown in FIGS. 2, 3, 4 and 5, respectively, may be implemented in an example vehicle 701. In one example, the ANC system 700 may be configured to reduce or eliminate undesired sounds associated with the vehicle 701. For example, the undesired sound may be road noise 702 (represented in FIG. 7 as a dashed arrow) associated with, for example, tires 703. However, various undesired sounds may be targeted for reduction or elimination such as engine noise or any other undesired sound occurring in or associated with the vehicle 701. The road noise 702 may be detected by at least one reference sensor that provides at least one reference signal. In one example, the at least one reference sensor may be two accelerometers 704, which may generate road noise signals 705, which serve as reference signals for the ANC system 700 based on a current operating condition of the tires 703, the road noise signals (or reference signals) are indicative of the level of the road noise 702. Other methods of sound detection may be implemented, such as microphones, non acoustic sensors, or any other sensors suitable to detect audible sounds associated with the vehicle 701, e.g., the tires 703 or an engine 706.

The vehicle 701 may include various audio/video components. In FIG. 7, the vehicle 701 is shown as including an audio system 707. The audio system 707 may include various devices for providing audio/visual information, such as an AM/FM radio, CD/DVD player, mobile phone, navigation system, MP3 player, or personal music player interface. The audio system 707 may be embedded in the dash board 708, e.g., in a head unit 709 disposed therein. The audio system 707 may also be configured for mono, stereo, 5-channel, and 7-channel operation, or any other audio output configuration. The audio system 707 may include a plurality of loudspeakers in the vehicle 701. The audio system 707 may also include other components, such as one or more amplifiers (not shown), which may be disposed at various locations within the vehicle 701 such as a trunk 710.

In one example, the vehicle 701 may include a plurality of loudspeakers, such as a left rear loudspeaker 711 and a right rear loudspeaker 712, which may be positioned on or within a rear shelf 713. The vehicle 701 may also include a left side loudspeaker 714 and a right side loudspeaker 715, each mounted within a vehicle rear door 716 and 717, respectively. The vehicle 701 may also include a left front loudspeaker 718 and a right front loudspeaker 719, each mounted within a vehicle front door 720, 721, respectively. The vehicle 701 may also include a center loudspeaker 722 positioned within the dashboard 708. In other examples, other configurations of the audio system 707 in the vehicle 701 are possible.

In one example, the center loudspeaker 722 may be used, similar to speaker(s) 104 in the system shown in FIGS. 2 to 6, to transmit anti-noise to reduce road noise 702 that may be heard in a target space 723. In one example, the target space 723 may be an area proximate to a driver's ears, which may be proximate to a head rest 724 of a driver seat 725. In FIG. 7, an error sensor such as a microphone 726 may be disposed in, at or adjacent to the head rest 724. The microphone 726 may be connected to the ANC system 700 in a manner similar to microphone(s) 102 described in connection with FIGS. 2 to 6. In FIG. 7, the ANC system 700 and audio system 707 are connected to the center loudspeaker 722, so that signals generated by the audio system 707 and the ANC system 700 may be combined to drive center loudspeaker 722 and produce a loudspeaker output 727 (represented as dashed arrows). This loudspeaker output 727 may be produced as a sound wave so that the anti-noise destructively interferes with the road noise 702 in the target space 723. One or more other loudspeakers in the vehicle 701 may be selected to produce a sound wave that includes cancelling output sound, i.e., anti-noise. Further, the microphone 726 may be placed at various positions throughout the vehicle in one or more desired target spaces. As can be seen from FIG. 7, the audio signal reproduced as sound by one or more loudspeakers such as loudspeaker 722 may be transmitted to the reference sensor, e.g., accelerometer 704 and/or to the error sensor, e.g., microphone 726, and generate signal components in the reference signal and/or the error signal that refer back to the audio signal.

Figure 8:
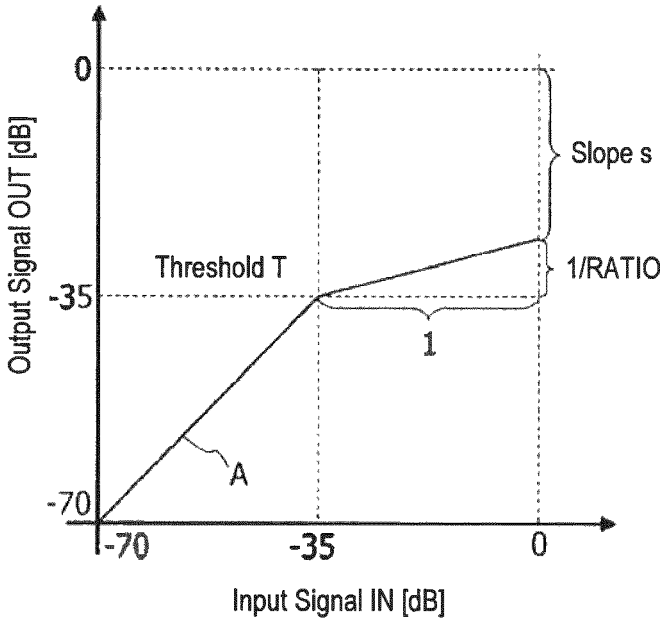
FIG. 8 is a diagram illustrating a static transfer characteristic of an example limiter applicable in the systems shown in FIGS. 2 to 6.
Figure 9:
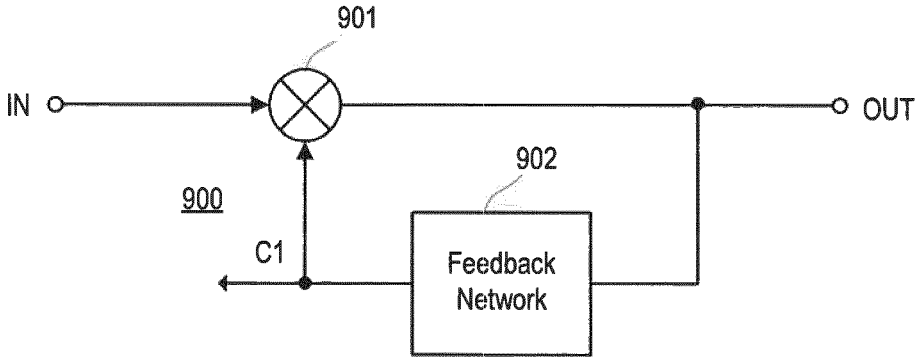
FIG. 9 is a schematic diagram illustrating an example limiter with a feedback structure applicable in the systems shown in FIGS. 2 to 6.
Figure 10:
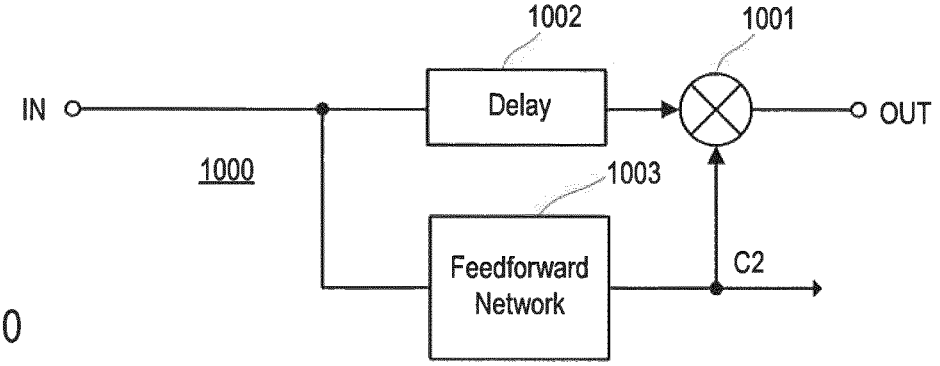
FIG. 10 is a schematic diagram illustrating an example limiter with a feedforward structure applicable in the systems shown in FIGS. 2 to 6.

Referring now to FIGS. 8 to 10, limiters (herein including compressors) can be seen as amplifiers with controllable gain or correspondingly operated digital signal processors configured to limit the dynamic range of a signal input into the limiter, referred to as limiter input signal. The dynamic range of the limiter input signal is reduced while its original temporal structure is retained. A control signal configured to control the gain of the amplifier may be derived from a level of the limiter input signal, for example, using an envelope tracer. The amplifier adjusts the level of the processed input signal, referred to as limiter output signal, by decreasing its gain if the level of the limiter input signal exceeds a certain (may be predetermined) limiter threshold level. Conversely, the gain of the amplifier is increased if the level of the limiter input signal undercuts the limiter threshold level. The dynamic range of the processed signal is thus reduced.

The static transfer characteristic is depicted in FIG. 8, wherein abscissa values designate levels of a limiter input signal IN (input levels) and ordinate values levels of a limiter output signal OUT (output level), both in decibels (dB). For input levels up to a limiter threshold level T, which is −35 dB in this example, the gain of the compressor is unity or zero decibel, which means that the output levels correspond to the input levels. For input levels above the threshold level T, the gain is reduced according to an example compression ratio of 4:1. The compression ratio is formally defined as $$\text{RATIO} = \frac{\text{IN} - T}{\text{OUT} - T}, \text{ for IN} > T \text{ and OUT} > T \tag{6}$$

in which threshold T, output signal OUT, and input signal IN are denominated in dB. The compression ratio represents the ratio between the excess (IN-T) of the input level over the threshold level T, and the excess (OUT-T) of the output level over the threshold level T. For example, a compression ratio RATIO of 2:1 means an attenuation of the input signal level above the threshold level by a factor of 2. The total static gain $\text{GAIN}_{STAT}$ of the compressor is thus given by $$GAIN_{STAT} = (T - \text{IN}) \cdot \left(1 - \frac{1}{\text{RATIO}}\right), \text{ for IN} > T, \tag{7}$$

in which the static gain $\text{GAIN}_{STAT}$ is denoted in dB. For input signal levels below the threshold level T, the static gain $\text{GAIN}_{STAT}$ is, as already mentioned, at a zero decibel. Compressors may have a compression ratio RATIO between 1.3:1 and 3:1. Compressors with a ratio above 8:1 may be referred to as limiters, although no precise designation exists.

The factor "1-1/Ratio" represents the deviation of the gain from a linear curve and is also called "slope" S. Consequently, the static gain $\text{GAIN}_{STAT}$ can be expressed in terms of a slope s as $$\text{GAIN}_{STAT} = (T - IN) \cdot s, \text{ for } IN > T. \tag{8}$$

A limiter may have a slope s between approximately 0.9 and 1.0, while a compressor may have a slope between approximately 0.1 and 0.5.

It is clear that the gain of any controlled amplifier cannot be adjusted in an infinite short time interval. The adjustment of the gain is usually determined by the dynamics of a feedforward or a feedback circuit, which can be described (among others) by the directly or indirectly configurable parameters "attack time" and "release time". The attack time defines the time lag from when the threshold level T is exceeded to the time of maximum compression. The release time defines how fast the compression of the signal is removed once the level falls below the threshold, i.e., the time lag from when the threshold level T is undercut to the time of no compression of the signal. Exemplary design parameters of a limiter can thus be the threshold T, the compression ratio RATIO, the attack time, and the release time.

Limiters may operate either consistently with fixed gain control characteristics (in a feedback or feedforward signal path) or consistently with adaptive characteristic for the attack time and release time parameters throughout the entire frequency and level range. For example, a fixed characteristic for the attack time parameter may be insusceptible to a large extent to volume pumping, but can cause undesirable signal distortion for audio signals with relatively low frequencies. Other designs of limiters encompass control characteristics for which the attack time and release time parameters (or the compression ratio) are dependent on the amount by which the threshold level is exceeded (adaptive characteristic). Limiters derive parameters from at least one of the input signals and output signals to control the input signal using an amplifier with controllable gain. The control algorithm can have a feedback structure, a feedforward structure or a combination thereof, since the variable gain may depend on the input signal x, the output signal y or both in connection with some control parameters such as attack time, release time, etc.

A simple feedback structure for a limiter (compressor) is shown in FIG. 9 and includes a controllable gain amplifier, represented by a multiplier 901, which receives the input signal IN and a gain control signal C1 from a feedback network 902. The feedback network 902 is supplied with the output signal OUT of the multiplier 901 and may include, for example, attack and release gain control elements, etc. A simple feedforward structure for a limiter (compressor) is shown in FIG. 10 and includes a controllable gain amplifier, represented by a multiplier 1001, which receives the input signal IN via a delay element 1002 and a gain control signal C2 from a feedforward network 1003. The feedforward network 1003 is supplied with the input signal IN and may include at least one of peak level meters, root-mean-square (RMS) level meters, transfer characteristics, logarithm taking elements, smoothing filters, attack and release gain control elements, etc.

Since the limiter activity may not or not only affect the signal under examination, i.e., may limit the signal, but may also have an impact on the FXLMS update mechanism as described above, the limiter activity may be monitored. Monitoring can be performed in multiple different ways, but herein, for the purpose of explanation, only a simple but nevertheless efficient way is described which already takes into account any existing attack and release timings. For example, by simply comparing the amplification (gain) of a particular limiter, which is currently applied to the signal under examination or which is suggested for application but is actually not applied, with a default limiter amplification (gain), the limiter activity is monitored and the update mechanism may be fully or partially suspended dependent on the result of the monitoring of the limiter, i.e., on whether the limiter's current amplification is below the default limiter amplification (limiting mode) or not (normal mode).

Figures 11, 12:
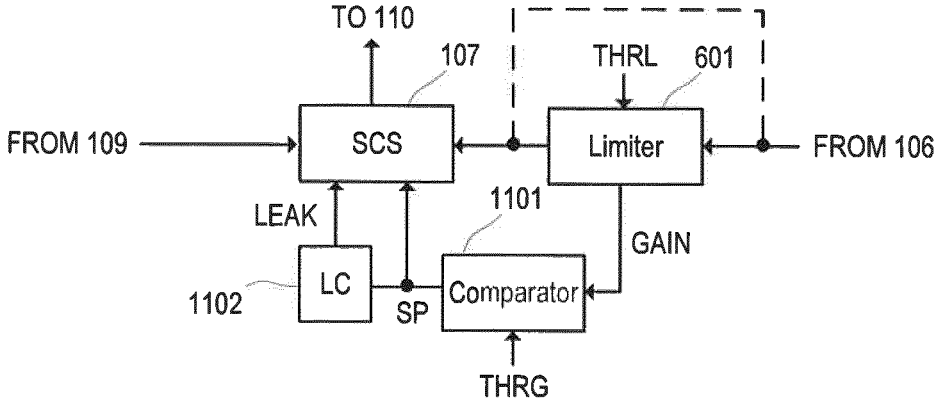
FIG. 11 is a schematic diagram illustrating an example suspension mechanism applicable in the systems shown in FIGS. 2 to 6.
FIG. 12 is a table illustrating an exemplary update scheme using different update modes in different situations.

Referring to FIG. 11, for example, the system described above in connection with FIG. 6 may be a single channel system (for explanation purposes) and may be altered such that the limiter 601 operates with a limiter threshold THRL, as described above in connection with FIG. 8, and provides to a comparator 1101, a gain control signal GAIN, which may be similar to the gain control signals C1 and C2 shown in FIGS. 9 and 10, and which represents the current and actual gain (amplification) of the limiter 601. The comparator 1101 compares the gain control signal GAIN with a gain threshold THRG that represents a default limiter gain, and controls, based on the result of the comparison as represented by a signal SP, the controller 107 to proceed to fully or partially suspend the update operation, as can be seen from equation (4). If, for example, the limiter is included in the output signal path, the signal SP is also evaluated by a leakage controller 1102 which detects a situation in which the controller 107 alters the update operation and controls the controller 107 to individually tuned, frequency dependent limiter leakage values, as can be seen from equation (5). Controller 107 replaces the "normal" leakage $\Delta_{k,m}[k]$ by the "specific" leakage $\Delta_{output\text{-}lim_{k,m}}[k]$, which applies, however, here only for a limiter included in the output signal path. Returning to the update processing employing the "normal" leakage $\lambda_{k,m}[k]$ is only admissible if no limiter is active.

For example, one of the following modes of operation may apply if the first condition is met, e.g., the error signal from the time-to-frequency domain transformer 106 exceeds the threshold THRL: (a) The signal under examination in this example, the error signal from the time-to-frequency domain transformer 106, may be limited but the update mechanism may not be suspended, e.g., because the error signal exceeds the threshold THRL but the gain of the limiter 601 does not exceed the threshold THRG and thus the first condition is met but not the second condition. (b) The update mechanism may be suspended but the error signal may not be limited, e.g., because the limiter is bypassed (as indicated by a dotted line in FIG. 11) but nevertheless operates (is active) with a certain gain that exceeds the threshold THRG. (c) The error signal may be limited, e.g., because the error signal exceeds the threshold THRL, and the update mechanism is suspended, e.g., because the gain of the limiter exceeds the threshold THRG. (d) If the error signal from the time-to-frequency domain transformer 106 does not exceed the threshold THRL, neither is the error signal limited nor the update mechanism suspended.

Figure 6:
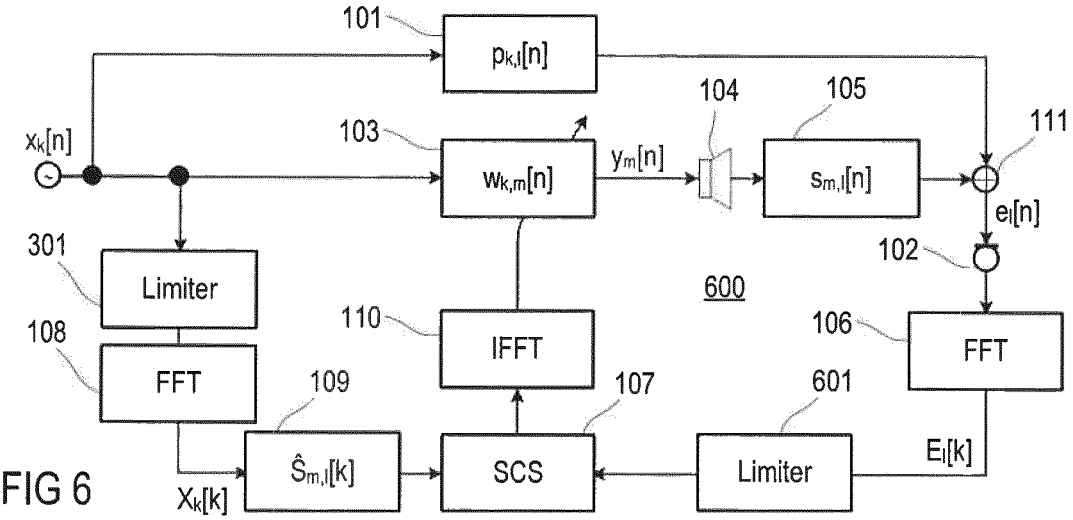
FIG. 6 is a schematic diagram illustrating the automatic noise control system shown in FIG. 3 with an additional frequency domain limiters in error control paths.

If the error signal from the time-to-frequency domain transformer 106 exceeds the threshold THRL, the current gain (amplification) of the limiter 601 may be set to a default amplification, otherwise to one or more limiting gains. The current gain is monitored by way of the comparator 1101 and, if the current gain undercuts the threshold THRG, which may be identical or similar to the default amplification, the update operation is suspended as indicated and controlled by signal SP. The leakage controller 1102 monitors the signal SP and, if the signal SP indicates that the update operation is to be resumed, predetermined leakage values are sent to the controller 107. The mechanism shown and described in connection with FIGS. 6 and 11 is also applicable, with minor modifications, in the systems shown in FIGS. 2 to 5.

Different exemplary situations and the corresponding update processing schemes are compiled in the table shown in FIG. 12. If no limiter is active, the process according to equation (3) applies. If only the error limiter is active or only the reference limiter is active or only the error limiter and the reference limiter are active, and all respective other limiters are inactive, the process according to equation (4) applies. If at least the output limiter is active, the process according to equation (4) applies.

Figure 13:
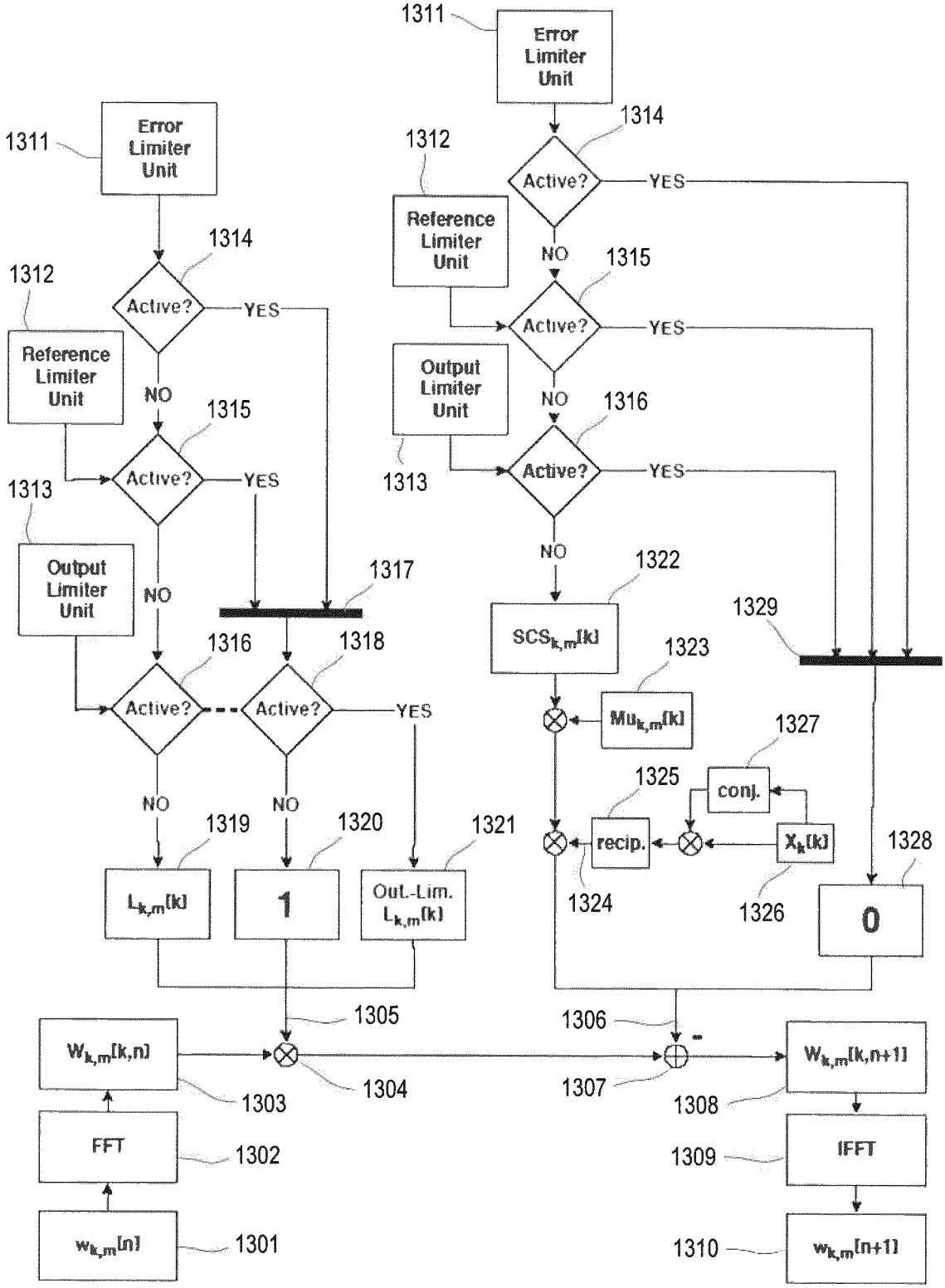
FIG. 13 is a signal flow chart illustrating the application of a leakage matrix and an update term matrix in a signal limiting method implemented in a controller.

FIG. 13 shows a signal flow structure implemented in a controller (not shown) with a frequency dependent leakage factor matrix of full or partial size K×M, depending on active k reference and/or m output limiter channels or at least one error limiter channel, within the w-filter matrix update applied in the frequency domain and in connection with, e.g., a Finite Impulse Response (FIR) filter. A fully or partially non-updated (K×M) matrix 1301 of w FIR filter taps, depending on active k reference e and/or m output limiter channels or one at least one error limiter channel, is received and converted from the time domain into the frequency domain by way of a FFT operation 1302 to provide a fully or partially non-updated (K×M) matrix 1303 in the frequency domain, depending on active k reference e and/or m output limiter channels or at least one error limiter channel. This fully or partially non-updated (K×M) matrix 1303 in the frequency domain, depending on active k reference e and/or m output limiter channels or at least one error limiter channel, is multiplied in multiplication operation 1304 with a corresponding leakage factor or leakage matrix 1305, depending on active k reference e and/or m output limiter channels or at least one error limiter channel. From the result of this multiplication operation 1304, a matrix of update terms 1306 in the frequency domain is subtracted in a subtraction operation 1307. The result of this subtraction operation 1307 is representative of the fully or partially updated (K×M) matrix 1308 of w FIR filter taps in the frequency domain. This fully or partially updated (K×M) matrix 1308 of w FIR filter taps is converted from the frequency domain into the time domain by way of a IFFT operation 1309 to output an updated (K×M) matrix 1310 of w FIR filter taps in the time domain.

In the flow chart shown in FIG. 13, n stands for the $n^{th}$ sample in the time domain, k stands for the $k^{th}$ bin in the frequency domain, K is the number of reference signals, E is the number of error channels, and M is the number of loudspeakers. Furthermore, $w_{k,m}[n]$ with k=1 . . . K and m=1 . . . M stands for the non-updated (K×M) matrix 1301 of w FIR filter taps in the time domain, $W_{k,m}[k,n]$ with k=1 . . . K and m=1 . . . M stands for the non-updated (K×M) matrix 203 of w FIR filters taps in the frequency domain, $w_{k,m}[n+1]$ with k=1 . . . K and m=1 . . . M, stands for the updated (K×M) matrix 1310 of w FIR filters taps in the time domain, and $W_{,k,m}[k,n+1]$, with k=1 . . . K and m=1 . . . M, stands for the updated (K×M) matrix 1308 of W FIR filters taps in the frequency domain The leakage factor 1305, which may assume one of a first variable value $L_{k,m}[k]$, constant value 1 or limited variable value Out.-Lim. $L_{k,m}[k]$ depending on the specific situation, can be regarded as the w-filter's "oblivion" factor, with which the currently adapted w-filter coefficient values will be "forgotten", i.e. slowly driven to zero. The leakage factor 1305 may be tunable over frequency for each individual w-filter matrix element. If the leakage shall be used as an individual multiplication factor, the w-filter update may be performed in the frequency domain in order to avoid an otherwise required, complicated convolution. However, by definition, introduction of a leakage factor reduces the system performance because leakage and the update term act against each other. Therefore, in the following, leakage may only be used as an instrument for protection against instability due to changes in the secondary paths. Despite that, Out.-Lim. $L_{k,m}[k]$ can fully or partially replace "normal" $L_{k,m}[k]$, if one or more of the m output limiter channels are active, in order to "fade-out" the w-filter values for securing control operation in combination and to suspend fully or partially the affected update terms SCSk,m[k]. Furthermore, basic control features which provide control over the w-filter update via leakage and the update term are introduced. The matrix of update terms 1306, which represents frequency dependent spatial freeze update terms in the frequency domain, may, fully or partially, assume a matrix $SCS_{k,m}[k]$ that is subsequently modified or the constant value 0 as the case may be. Thus, the update process may even be fully or partially disabled by the freeze mechanism.

An error limiter unit 1311, a reference limiter unit 1312 and an output limiter unit 1313 are each monitored in view of their activity. A decision 1314 is made whether the error limiter unit 1311 is active or not. If the error limiter unit 1311 is not active, i.e. decision 1314 is negative (NO), a decision 1315 is made whether the reference limiter unit 1312 is active or not. If the output limiter unit 1312 is not active, i.e., decision 1315 is negative, a decision 1316 is made whether the output limiter unit 1313 is active or not. If the output limiter unit 1313 is not active, i.e., decision 1316 is negative, the leakage matrix 1305 is set to a first leakage matrix 1319, e.g., variable matrix $L_{k,m}[k]$. Further, if an OR conjunction 1317 detects whether at least one of the decisions 1314 and 1315 is positive (YES), i.e., at least one of the error limiter unit 1311 and the reference limiter unit 1312 is active, a decision 1318 is made whether decision 1316 is positive or negative. If it is negative, i.e., the output limiter unit 1313 is not active, the leakage matrix 1305 is set to a second leakage matrix 1320, e.g., a unit matrix with constant value "1". If it is positive, i.e., the output limiter unit 1313 is active, the leakage matrix 1305 is set to a third leakage matrix 1321, e.g., limited variable leakage matrix Out.-Lim. $L_{k,m}[k]$.

The results of the decisions 1314, 1315 and 1316 may be further evaluated to generate the matrix of update terms 1306. If the decision 1316 is made and turns out to be negative, the matrix of update terms 1306 is set to a first matrix 1322, e.g., the matrix $SCS_{k,m}[k]$, modified by way of (e.g., multiplied with) a second matrix, e.g., a matrix $Mu_{k,m}[k]$, and a first vector 1324. The first vector 1324 may be the reciprocal function 1325 of a second vector 1326, e.g., $x_k[k]$, after being multiplied with its conjugate 1327. The matrix of update terms 1306 is set to a third matrix 1329, e.g., a unit matrix with constant value "0", if an OR conjunction 1328 detects that at least one of the decisions 1314, 1315 and 1316 has a positive result.

Figure 14:
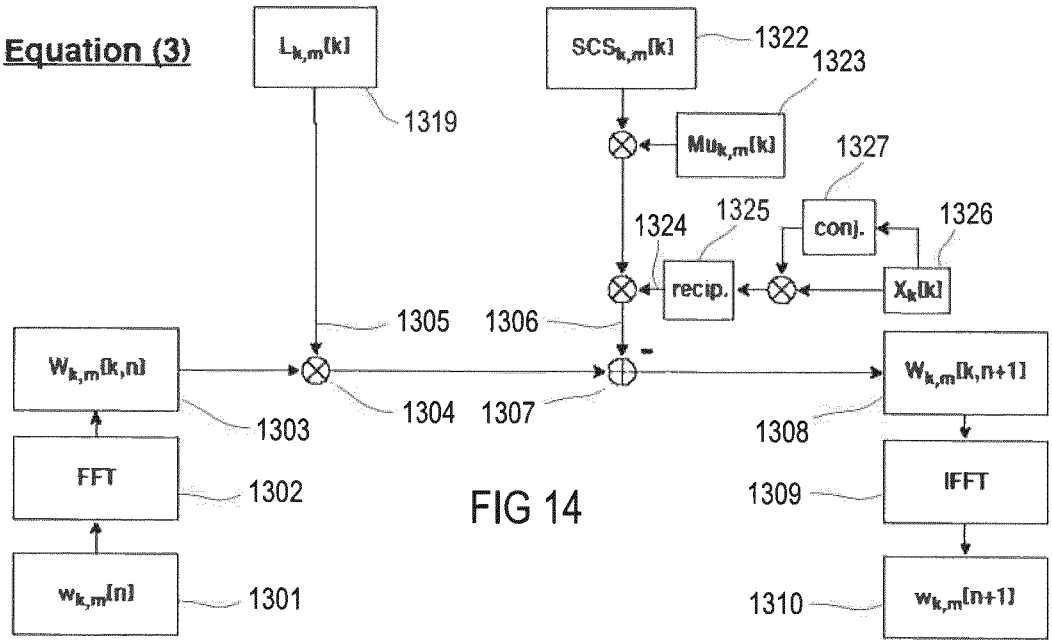
FIG. 14 is a signal flow chart illustrating one mode of operation outlined in the table shown in FIG. 12 when implemented in the signal limiting method shown in FIG. 13.
Figure 15:
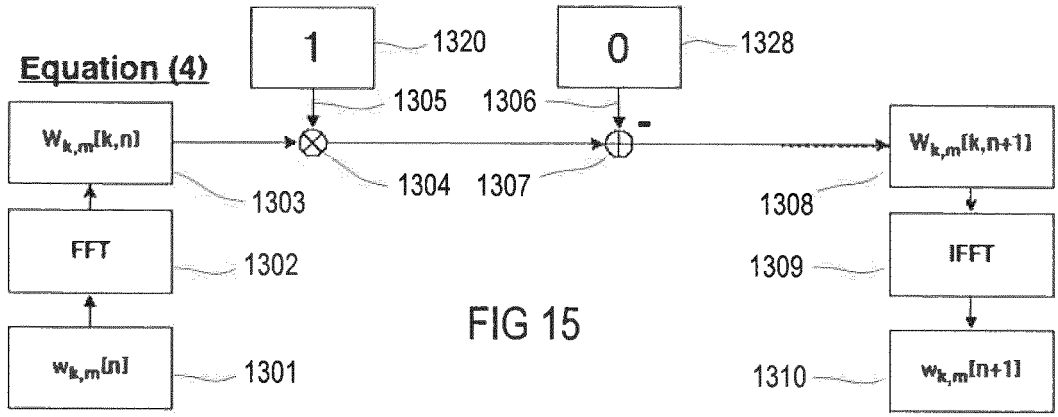
FIG. 15 is a signal flow chart illustrating another mode of operation outlined in the table shown in FIG. 12 when implemented in the signal limiting method shown in FIG. 13.
Figure 16:
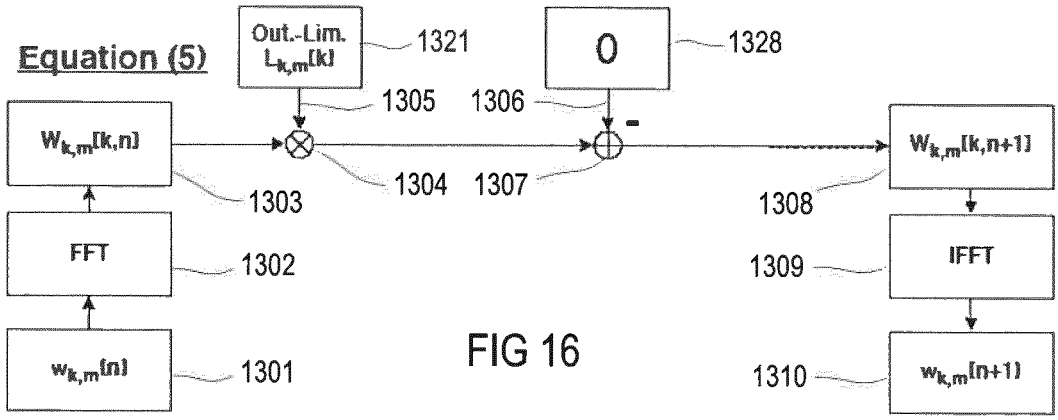
FIG. 16 is a signal flow chart illustrating still another mode of operation outlined in the table shown in FIG. 12 when implemented in the signal limiting method shown in FIG. 13.

The signal flow structure including elements 1311-1329 implements the different modes of operation outlined in the table shown in FIG. 12 and described by way of equations (3)-(5). FIGS. 14-16 illustrate the signal flow structure shown in FIG. 13 simplified in view of equation (3) as can be seen from FIG. 14, equation (4) as can be seen from FIG. 15 and equation (5) as can be seen from FIG. 16. In the signal flow structure shown in FIG. 14, which corresponds to equation (3), the leakage matrix 1305 is set to the leakage matrix 1305 is set to the first leakage matrix 1319, e.g., variable matrix $L_{k,m}[k]$, and the matrix of update terms 1306 is set to the first matrix 1322, e.g., the matrix $SCS_{k,m}[k]$, modified by way of (e.g., multiplied with) a second matrix, e.g., a matrix $Mu_{k,m}[k]$, and a first vector 1324 which is the reciprocal function 1325 of a second vector 1326, e.g., $x_k[k]$, after being multiplied with its conjugate 1327. In the signal flow structure shown in FIG. 15, which corresponds to equation (4), the leakage matrix 1305 is set to the second leakage matrix 1320, e.g., a unit matrix with constant value "1", and the matrix of update terms 1306 is set to third matrix 1329, e.g., a unit matrix with constant value "0". In the signal flow structure shown in FIG. 16, which corresponds to equation (5), the leakage matrix 1305 is set to the third leakage matrix 1321, e.g., limited variable leakage matrix Out.-Lim. $L_{k,m}[k]$, and the matrix of update terms 1306 is set to third matrix 1329, e.g., a unit matrix with constant value "0".

In an exemplary modification of the implementation shown in FIG. 11, which is described below with reference to FIG. 17, instead of employing two thresholds for a decision whether only signal limiting or additionally modifying the update mechanism is applied, each limiter has a single individual threshold and the decision, whether only limiting or only modifying the update mechanism or both are adjustable or tunable. If the signal to be limited exceeds a threshold THRL, one of a multiplicity of configurations is selected. For example, three configurations Config-A, Config-B, and Config-C may be chosen. In configuration Config-A, the (output) signal is limited by applying the amplification $\alpha_{lim_current}$ and the update mechanism is not affected, i.e., the operating mode according to equation (3) is applied. In configuration Config-B, no limiting of the output signal takes place, only the potential amplification $\alpha_{lim_current}$ applied, i.e., the amplification that would be applied when a limitation would take place. Further, depending on the result of the comparison whether $\alpha_{lim_current}<\alpha_{lim_default}$, and whether which limiter is active, apply update mechanism according to equation (4) or (5). In configuration Config-C, the (output) signal is limited by applying the amplification $\alpha_{lim_current}$. Further, depending on the result of the comparison whether $\alpha_{lim_current}<\alpha_{lim_default}$, and whether which limiter is active, apply update mechanism according to equation (4) or (5).

Figure 18:
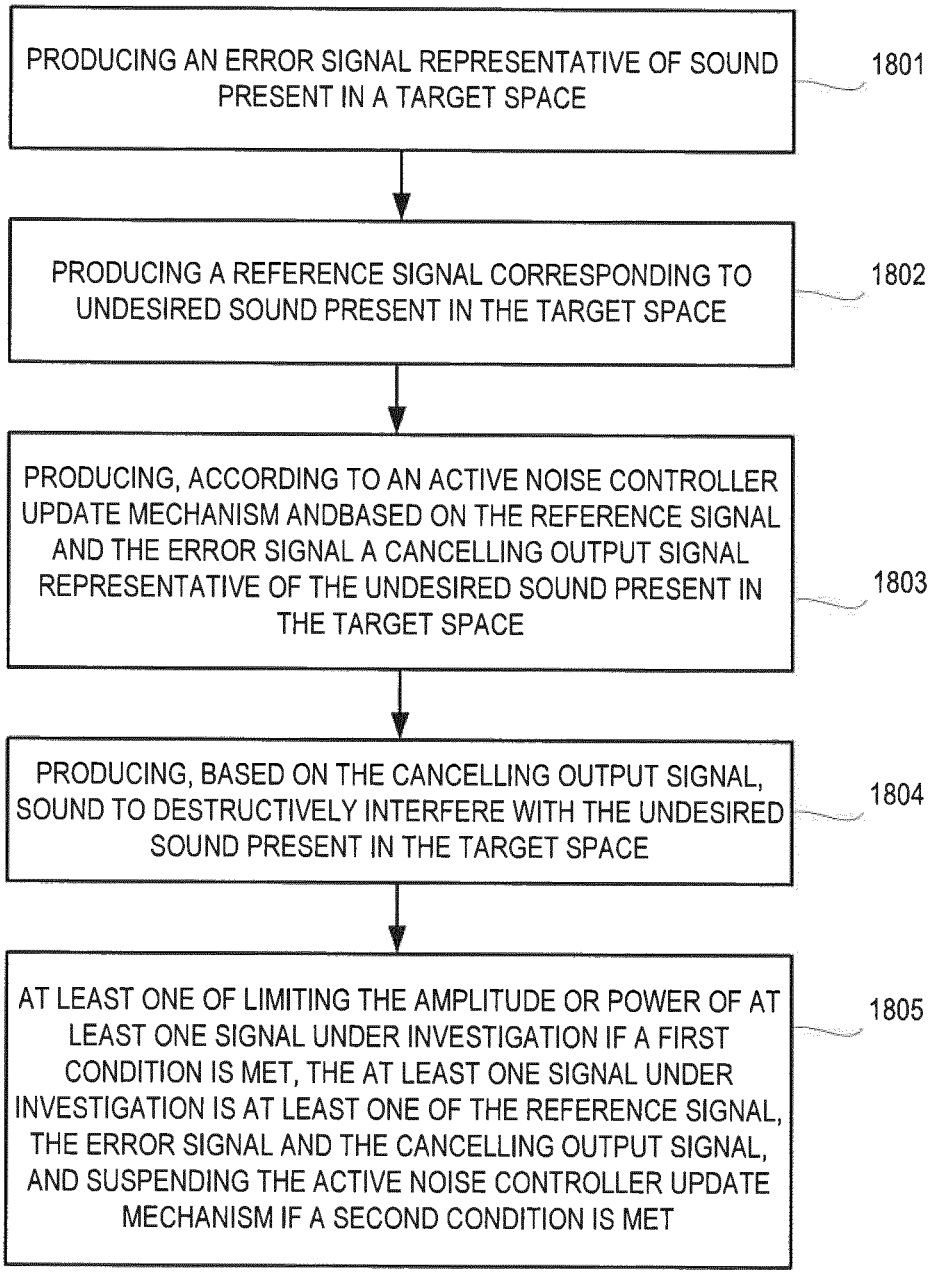
FIG. 18 is a flow chart illustrating an exemplary automatic noise control method.

Referring to FIG. 18, an exemplary ANC method includes producing an error signal representative of sound present in a target space (procedure 1801), producing a reference signal corresponding to undesired sound present in the target space (procedure 1802), and producing, based on the reference signal and the error signal a cancelling output signal representative of the undesired sound present in the target space (1803). The method further includes producing, according to an active noise controller update mechanism and based on the cancelling output signal, sound to destructively interfere with the undesired sound present in the target space (procedure 1804), and at least one of limiting the amplitude or power of at least one signal under examination if a first condition is met, the at least one signal under examination being at least one of the reference signal, the error signal and the cancelling output signal, and fully or partially suspending the active noise controller update mechanism if a second condition is met (procedure 1805).

Various exemplary implementations of partial updates are compiled in a table shown in FIG. 19. A partial update may be performed only in cases represented by lines or columns of the table in which a reference and/or output limiter is active. As the matrix is of the size K×M, partial updates may only affect the k reference and/or m output channels. The table with exemplary implementations shown in FIG. 19 involves one output channel (columns) and four reference channels (lines). Two columns refer to cases in which the respective limiter is not active and one is active, and four lines refer to four channel in which the third reference channel is active and the others are inactive. Therefore, the cases shown in the fourth column and the fourth line are affected by a partial update. However, if an error limiter is active, this does not affect the whole or parts of the matrix since an error signal cannot be assigned to a specific W filter matrix element. For example, when determining the matrix $SCS_{k,m}[k]$, all error signals are summed up so that an active error limiter affects the whole matrix $SCS_{k,m}[k]$ and, thus the whole Wfilter matrix.

The embodiments of the present disclosure generally provide for a plurality of circuits, electrical devices, and/or at least one controller. All references to the circuits, the at least one controller, and to other electrical devices, as well as the functionality provided by each of these, are not intended to be limited to encompass only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any computer, processor and controller as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any controller as disclosed utilizes any one or more microprocessors to execute a computer-program that is embodied in a non-transitory computer readable medium that is programmed to perform any number of the functions as disclosed. Further, any controller as provided herein includes a housing and the various number of microprocessors, integrated circuits, and memory devices (e.g., FLASH, random access memory (RAM), read only memory (ROM), electrically programmable read only memory (EPROM), electrically erasable programmable read only memory (EEPROM)) positioned within the housing. The computer(s), processor(s) and controller(s) as disclosed also include hardware based inputs and outputs for receiving and transmitting data, respectively from and to other hardware based devices as discussed herein.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. An automatic noise control system comprising:

an error sensor configured to produce an error signal representative of sound present in a target space;

a reference sensor configured to produce a reference signal corresponding to undesired sound present in the target space;

an active noise controller operatively coupled with the error sensor and the reference sensor, the active noise controller being configured to produce, according to an active noise controller update mechanism and based on the reference signal and the error signal, a cancelling output signal representative of the undesired sound present in the target space; and a transducer operatively coupled with the active noise controller and configured to produce, based on the cancelling output signal, sound to destructively interfere with the undesired sound present in the target space; wherein:

the active noise controller is further configured to;

limit an amplitude or a power of at least one signal under examination without suspending the active noise controller update mechanism in response to a first condition being met, the at least one signal under examination is at least one of the reference signal, the error signal and the cancelling output signal; and fully or partially suspend the active noise controller update mechanism in response to a second condition being met, wherein the active noise controller includes:

an adaptive filter being configured to receive the reference signal and to provide the cancelling output signal by filtering the reference signal with a controllable transfer function, wherein the active noise controller comprises a secondary path modelling filter which is operatively coupled with the active noise controller to limit the reference signal before the reference signal is received by the adaptive filter in response to the first condition being met and the active noise controller update mechanism is fully or partially suspended in response to the second condition being met, wherein the first condition is met in response to the amplitude or the power of the at least one signal under examination exceeding a respective limiter threshold, and wherein the active noise controller is further configured to operate with a first limiter gain in response to the first condition not being met and with at least one second limiter gain in response to the first condition being met, the at least one second limiter gain being less than the first limiter gain.

2. The system of claim 1, wherein the second condition corresponds to the at least one second limiter gain being less than a gain threshold.

3. The system of claim 1, wherein:

the active noise controller further includes:

a filter controller being configured to receive the reference signal and the error signal, and to control the transfer function of the adaptive filter according to an adaptive control scheme based on the reference signal and the error signal.

4. The system of claim 3, wherein the secondary path modelling filter has a transfer function that is an estimate of a transfer function of an acoustic secondary path between the transducer and the error sensor.

5. The system of claim 3, wherein the adaptive filter is operated in a time domain and the filter controller is operated in a frequency domain.

6. The system of claim 3, wherein an adaptive control scheme of the filter controller employs a summed cross spectrum.

7. The system of claim 3, wherein:

a first limiter is operatively coupled with the filter controller; and the reference signal is limited before the reference signal is received by the filter controller in response to the first condition being met, or the active noise controller update mechanism is fully or partially suspended in response to the second condition being met.

8. The system of claim 3, wherein:

a first limiter is operatively coupled with the filter controller; and the error signal is limited before is the error signal is received by the filter controller in response to the first condition being met, or the active noise controller update mechanism is fully or partially suspended in response to the second condition.

9. The system of claim 1, wherein:

a first limiter is fully or partially coupled with the adaptive filter; or the reference signal is limited before the reference signal is received by the adaptive filter in response to the first condition being met and the active noise controller update mechanism is fully or partially suspended in response to the second condition being met.

10. The system of claim 1, wherein a first limiter is operatively coupled with the adaptive filter so that the cancelling output signal is limited before the canceling output signal is received by the transducer.

11. The system of claim 1 further comprising a first limiter that operates with a first amplification in response to an amplitude or power of a signal to be limited is below a threshold, and that operates with a second amplification response to an amplitude or power of the signal to be limited is above the threshold, wherein the first amplification is greater than the second amplification.

12. The system of claim 1, wherein the active noise controller update mechanism, after being fully or partially suspended and while returning to operation, employs dedicated leakage values for an update that are tunable over frequency for filter matrix elements.

13. A sound reduction method comprising:

producing an error signal representative of sound present in a target space;

producing a reference signal corresponding to undesired sound present in the target space;

producing, according to an active noise controller update mechanism and based on the reference signal and the error signal, a cancelling output signal representative of the undesired sound present in the target space;

producing, based on the cancelling output signal, sound to destructively interfere with the undesired sound present in the target space;

limiting an amplitude or a power of at least one signal under examination without suspending the active noise controller update mechanism in response to a first condition being met, the at least one signal under examination is at least one of the reference signal, the error signal and the cancelling output signal; and fully or partially suspending the active noise controller update mechanism in response to a second condition being met, receiving the reference signal via an adaptive filter which provides adaptive filtering to provide the cancelling output signal by filtering the reference signal with a controllable transfer function, and limiting the reference signal before the reference signal is received by the adaptive filter via a secondary path modelling filter that is operatively coupled with an active noise controller to limit the reference signal before the reference signal is received by the adaptive filter in response to the first condition being met and the active noise controller update mechanism is fully or partially suspended in response to the second condition being met, wherein the first condition is met in response to the amplitude or the power of the at least one signal under examination exceeding a respective limiter threshold, and wherein limiting the amplitude or the power of at least one signal under examination employs a first limiter gain in response to the first condition not being met and at least one second limiter gain in response to the first condition being met, the at least one second limiter gain being less than the first limiter gain.

14. The method of claim 13, wherein the second condition is met in response to the at least one second limiter gain undercutting a gain threshold.

15. The method of claim 13, wherein the adaptive filtering includes controlling the transfer function of the adaptive filtering according to an adaptive control scheme based on the reference signal and the error signal.

16. The method of claim 15, wherein the further secondary path modelling filtering employs a transfer function that is an estimate of a transfer function of an acoustic secondary path between a transducer that produces, based on the cancelling output signal, sound to destructively interfere with the undesired sound present in the target space and an error sensor that produces an error signal representative of sound present in a target space.

17. The method of claim 16, wherein the adaptive filtering is performed in a time domain and controlling the transfer function of the adaptive filtering is performed in a frequency domain.

18. The method of claim 17, wherein an adaptive control scheme for controlling the transfer function of the adaptive filtering employs a summed cross spectrum.

19. The method of claim 17, wherein a first limiting scheme is applied to the reference signal so that at least one of:

the reference signal is limited the reference signal forms a basis for adaptive filtering if the first condition is met; and the active noise controller update mechanism is fully or partially suspended if the second condition is met.

20. The method of claim 17, wherein a first limiting scheme is applied to the reference signal so that at least one of:

the reference signal is limited before the reference signal forms a basis for controlling the transfer function of the adaptive filtering in response to the first condition being met; and the active noise controller update mechanism is fully or partially suspended in response to the second condition being met.

21. The method of claim 17, wherein a first limiting scheme is applied to the error signal so that at least one of:

the error signal is limited before the error signal forms a basis for controlling the transfer function of the adaptive filtering in response to the first condition being met; and the active noise controller update mechanism is suspended in response to the second condition being met.

22. The method of claim 17, wherein a first limiting scheme is applied to the cancelling output signal so that the cancelling output signal is limited before the cancelling output signal forms a basis for producing the sound that destructively interferes with the undesired sound present in the target space in response to the first condition being met and the active noise controller update mechanism is fully or partially suspended in response to the second condition being met.

23. The method of claim 13, wherein limiting is performed with a first amplification in response to an amplitude or a power of a signal to be limited is below a threshold and limiting operates with a second amplification in response to an amplitude or the power of the signal to be limited is above the threshold, wherein the first amplification is greater than the second amplification.

24. The method of claim 13, wherein the active noise controller update mechanism, after being fully or partially suspended and while returning to operation, employs dedicated leakage values for an update that are tunable over frequency for filter matrix elements.

25. A computer-program product embodied in a non-transitory computer read-able medium that is programmed for providing a sound reduction, the computer-program product comprising instructions for:

producing an error signal representative of sound present in a target space;

producing a reference signal corresponding to undesired sound present in the target space;

producing, according to an active noise controller update mechanism and based on the reference signal and the error signal, a cancelling output signal representative of the undesired sound present in the target space;

producing, based on the cancelling output signal, sound to destructively interfere with the undesired sound present in the target space;

limiting an amplitude or a power of at least one signal under examination without suspending the active noise controller update mechanism in response to a first condition being met, the at least one signal under examination is at least one of the reference signal, the error signal, and the cancelling output signal;

fully or partially suspending the active noise controller update mechanism in response to a second condition being met;

receiving the reference signal via an adaptive filter which provides adaptive filtering to provide the cancelling output signal by filtering the reference signal with a controllable transfer function, and limiting the reference signal before the reference signal is received by the adaptive filter via a secondary path modelling filter that is operatively coupled with an active noise controller to limit the reference signal before the reference signal is received by the adaptive filter in response to the first condition being met and the active noise controller update mechanism is fully or partially suspended if the second condition is met, wherein the first condition is met in response to the amplitude or the power of the at least one signal under examination exceeding a respective limiter threshold, and wherein limiting the amplitude or the power of at least one signal under examination employs a first limiter gain in response to the first condition not being met and at least one second limiter gain in response to the first condition being met, the at least one second limiter gain being less than the first limiter gain.

* * * * *